United States Patent [19]

Kikuchi et al.

[11] 4,277,558

[45] Jul. 7, 1981

[54] LIGHT-SENSITIVE SILVER HALIDE COLOR PHOTOGRAPHIC MATERIALS

[75] Inventors: Shoji Kikuchi; Toshio Yajima; Kenichi Kishi; Takashi Sasaki, all of Hino; Keiichi Mori; Haruhiko Sato, both of Odawara, all of Japan

[73] Assignee: Konishiroku Photo Industry Co., Ltd., Tokyo, Japan

[21] Appl. No.: 151,941

[22] Filed: May 21, 1980

[30] Foreign Application Priority Data

Jun. 4, 1979 [JP] Japan ..... 54-69767

[51] Int. Cl.[3] ..... G03C 1/02

[52] U.S. Cl. ..... 430/542; 430/372; 430/388; 430/551

[58] Field of Search ..... 430/372, 551, 542, 388

[56] References Cited

U.S. PATENT DOCUMENTS

| | | | |
|---|---|---|---|
| 2,728,659 | 12/1955 | Loria et al. | 430/551 |
| 2,732,300 | 1/1956 | Thirtle et al. | 430/551 |
| 4,121,939 | 10/1978 | Adachi et al. | 430/551 |
| 4,198,239 | 4/1980 | Credner et al. | 430/372 |

OTHER PUBLICATIONS

James et al., "Fundamentals of Photography Theory", pp. 93–94, John Wiley & Sons, New York, 1948.

*Primary Examiner*—J. Travis Brown
*Attorney, Agent, or Firm*—Bierman & Bierman

[57] ABSTRACT

Silver halide photographic material containing hydroquinones and benzoquinones as anti-stain agents.

7 Claims, No Drawings

LIGHT-SENSITIVE SILVER HALIDE COLOR PHOTOGRAPHIC MATERIALS

This invention relates to light-sensitive silver halide color photographic materials and particularly to light-sensitive silver halide color photographic materials capable of assuring low fog density as well as high image density.

Generally, in forming color photographic images, there is adopted a process in which imagewise exposed silver halide grains are developed with an aromatic primary amine compound as a developing agent and an oxidation product of the aromatic primary amine compound thereby formed undergoes coupling reaction with dye forming couplers, which are usually those forming yellow, magenta and cyan dyes respectively, to form a dye image.

In this process, yellow couplers used usually to form yellow dyes are compounds having open chain active methylene groups, for example, benzoylacetanilide type couplers or pivaloylacetanilide type couplers and magenta couplers used to form magenta dyes are generally compounds having closed chain active methylene groups, for example, those having pyrazolone, pyrazolinobenzimidazole, indazolone or pyrazolotriazole nuclei. On the other hand, as cyan couplers for forming cyan dyes there are generally used phenol or naphthol type compounds having phenolic hydroxy groups.

The so-called 2-equivalent coupler has come to be used nowadays, said coupler having at the active point of the coupler—a portion of the coupler at which the coupling reaction of the coupler with an oxidation product of an aromatic primary amine developing agent takes place—a substituent which can readily split off therefrom at the time of coupling. The 2-equivalent coupler requires development of 2 moles of silver halide for forming 1 mole of a dye. That is, in the case of 2-equivalent coupler the amount of silver halide being one half of that necessary in an ordinary 4-equivalent coupler for forming a dye is sufficient for the purpose. Thus, the use of 2-equivalent couplers can afford not only an enormous economy in the silver consumption but also such technical advantages that the resulting image is improved in sharpness, because silver halide photosensitive layers can be made thinner by reduction in amounts of silver halide, and that the processing time required for development of light-sensitive photographic materials can be shortened.

However, the 2-equivalent couplers on the other hand have such a serous drawback of being liable to form color fog, though they possess some merits as mentioned above. That is to say, since the 2-equivalent couplers are liable to react with an oxidation product of an aromatic primary amine developing agent, they readily undergo the coupling reaction, even in a place where the exposed silver halide particles are not reduced (the place where an oxidation product of the developing agent must not exist in itself), with an oxidation product of the developing agent, which oxidation product is formed in the developing solution as a result of partial air oxidation of said developing agent during development and tends to form colored dyes in that place, and the thus formed colored dyes result in color fog.

It is needless to say that the formation of color fog does not solely depend on properties of couplers per se, but depends on properties of silver halide grains, in other words, conditions for the manufacture of the silver halide grains, including additives other than the couplers, or on conditions for storage of the manufactured photographic material products and also on conditions for development of said products.

In recent years, photographic films as well as color photographic printing papers have come to be highly sensitized.

It is a well known fact in the industry concerned that generally the higher a silver halide photosensitive material is intended to be sensitized, the more it becomes susceptible to outer factors such as manufacturing conditions as well as storage and development conditions employed, and whereby they are liable to the formation of fog.

Further, in the manufacture of silver halide photosensitive materials, they have come to be subjected to emulsion coating at higher speed in order to improve productivity thereof. That is, quick drying technique relying on the use of hot air kept at elevated temperature has come to be practiced.

However, generally the more the silver halide photosensitive materials is dried at elevated temperatures or the quicker it is dried, the more it becomes liable to the formation of fog on account of a pressure applied to silver halide particles, said pressure being brought thereon by a sudden contraction of the silver halide emulsions at that time when it is so treated.

Furthermore, the so-called high temperature development treatment has come to be adopted generally in order to shorten the time necessary for the development treatment of silver halide photosensitive materials.

However, it is also true that the higher the development of an exposed silver halide photosensitive materials is effected at elevated temperatures, the more the thus treated photosensitive material is liable to form fog.

In order to eliminate the formation of fog as aforesaid, there have heretofore been proposed numerous procedures. For instance, it is a well-known procedure to incorporate into emulsions nitrogen-containing heterocyclic compounds having hydroxy groups, typical of which is 4-hydroxy-6-methyl-1,3,3*a*, 7-tetrazaindene, and mercaptoazoles such as 5-mercapto-1-phenyltetrazole, 2-mercapto-benzthiazole, etc. However, these compounds' effect of removing fog formed by the high temperature development is not sufficient, though they are capable of eliminating fog formed at the time of manufacturing light-sensitive silver halide color photographic materials. If these compounds are used in large amounts in the emulsions in order to obtain a sufficient fog-removing effect, there is brought about a decrease in sensitivity of the resulting color photographic material, with the result that the color image obtained thereby deteriorates in its quality.

Another procedure of reducing the formation of fog includes the use of gallic acid and its salts as disclosed in Japanese Patent Publication No. 13496/1968 and of gallic acid alkyl esters as disclosed in U.S. Pat. No. 3,457,079. These compounds, however, are not effective in removing fog resulting from a high speed coating of emulsions by means of hot air drying at the time of manufacturing light-sensitive silver halide color photographic materials, though they are able to remove effectively fog formed on the color photographic materials stored under the circumstances of high temperature and humidity.

Other procedures of removing fog relying on the use of aminophenol derivatives are disclosed in British Patent No. 1,133,500, U.S. Pat. Nos. 2,336,327 and 2,403,721, those relying on the use of ascorbic acid and its esters are disclosed in U.S. Pat. Nos. 2,401,713 and 2,728,661, and that relying on the use of dihydroxymaleic acids is disclosed in U.S. Pat. No. 2,356,486. As a result of experiments conducted by the present inventors, however, it has been ascertained that these compounds do not exhibit a sufficient effect on inhibition of color stain caused by the use of 2-equivalent couplers, particularly yellow forming couplers, though they are considerably effective in inhibiting color stain due to 4-equivalent couplers.

An object of the present invention is primarily to provide a light-sensitive silver halide color photographic material giving a color image which is less in formation of fog and high in image density.

The object of the present invention is secondarily to provide a light-sensitive silver halide color photographic material capable of being subjected to high temperature development.

Other objects of the present invention will be obvious from explanation and examples of the invention hereinafter disclosed.

As a result of extensive studies and investigations on the influence of hydroquinones and p-benzoquinones on light-sensitive silver halide color photographic materials, the present inventors have found that the above-mentioned objects of the present invention can be accomplished by incorporating into at least one layer formed on a support at least one of compounds represented by the following general formula [I] and at least one of compounds represented by the following general formula [II]:

General formula [I]

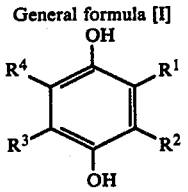

General formula [II]

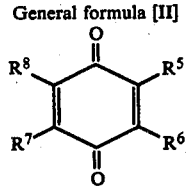

wherein $R^1$, $R^2$, $R^3$, $R^4$, $R^5$, $R^6$, $R^7$ and $R^8$ each represent a hydrogen or halogen atom, an alkyl, cycloalkyl, alkenyl, aryl, acyl, acylamino, sulfone or sulfonamido group, which may be the same or different, and each of said groups may have a substituent which does not substantially form a colored dye on reaction with an oxidation product of a developing agent.

In the general formulas [I] and [II], the halogen atom may be fluorine, chlorine, bromine or iodine, the alkyl group may include straight chain or branched alkyls, preferably those of 1 to 32 carbon atoms, e.g. methyl, ethyl, propyl, n-butyl, t-butyl, 2-ethyl-hexyl, 3,5,5-trimethylhexyl, n-octyl, t-octyl, t-undecyl, n-dodecyl, sec-dodecyl, t-heptadecyl, etc., the alkenyl group may include straight or branched alkenyls, preferably those of 2 to 32 carbon atoms, e.g. allyl, butenyl, octenyl or oleyl, the cycloalkyl group preferably includes 5 to 7 membered cycles, e.g. cyclopentyl, cyclohexyl or cycloheptyl, the aryl group includes, e.g. phenyl or naphthyl, the acyl group includes, e.g. acetyl, butanoyl, octanoyl, lauroyl, steroyl or benzoyl, the acylamino group includes, e.g. acetamido, octanoylamido or benzoylamino, and the sulfonamido group includes, e.g. methylsulfonamido, octylsulfonamido or phenylsulfonamido.

Further, the above-mentioned groups may individually have a substituent which does not substantially form a colored dye on reaction with an oxidation product of a color developing agent. Such substituent means a group having therein no active methylene or active methine and includes, e.g. a halogen atom, a hydroxy, carboxy, sulfo, cyano, alkyl, alkenyl, alkoxy, alkenyloxy, aryl, aryloxy, acyl, acylamino, carbamoyl, sulfonamido, sulfamoyl, alkoxycarbonyl or aryloxycarbonyl group.

The compounds represented by the general formulas [I] and [II] respectively (hereinafter called "the present compounds" unless otherwise specified) are preferably those in which, then one of the substituents represents a halogen atom or an acyl group, the other substituents are individually a hydrogen atom, an alkyl, cycloalkyl or alkenyl group, and in which all substituents on the same nucleus are not hydrogen atoms. More preferably, the present compounds have on the nucleus at least one alkyl, cycloalkyl, alkenyl or aryl group.

As to compounds of general formula [I], preferable examples are represented by following formula [I-a]:

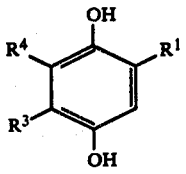

[I-a]

wherein $R^1$ is an alkyl group as mentioned above, and $R^3$ and $R^4$ are each a hydrogen atom or an alkyl group, preferably one of them is an alkyl group as mentioned above. More preferably the alkyl group for $R^1$, $R^3$ and $R^4$ is a secondary or tertiary alkyl group having 4 to 20 carbon atoms.

Typical examples of the present compounds are exemplified below.

Examples of the compound represented by the general formula [I]:

[I]-1

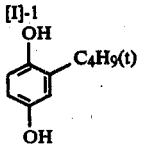

[I]-2

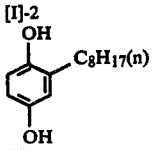

[I]-3

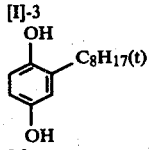

[I]-4

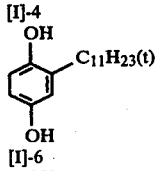

[I]-5

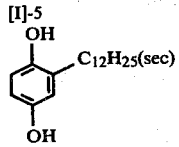

[I]-6

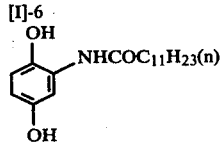

[I]-7

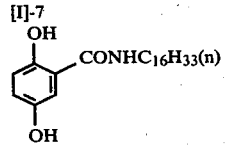

[I]-8

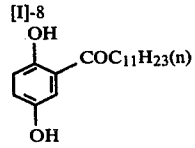

[I]-9

[I]-10

-continued
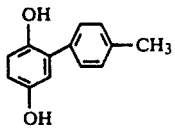
[I]-11
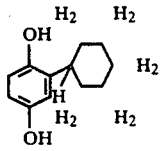
[I]-12
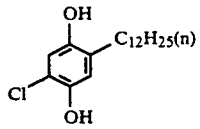
[I]-13
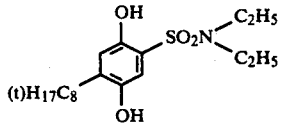
[I]-14
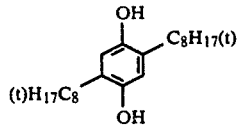
[I]-15
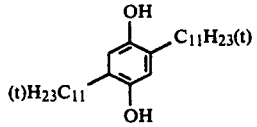
[I]-16
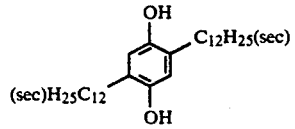
[I]-17
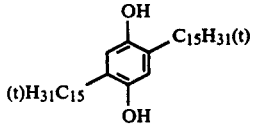
[I]-18
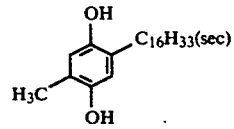
[I]-19
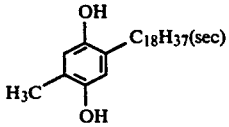
[I]-20
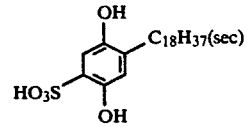
[I]-21
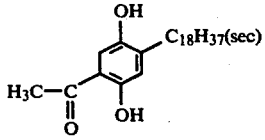
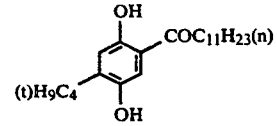
[I]-22
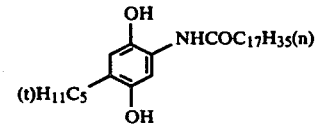
[I]-23
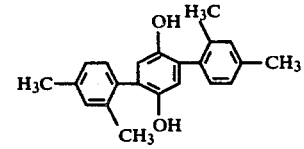
[I]-24
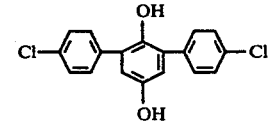
[I]-25
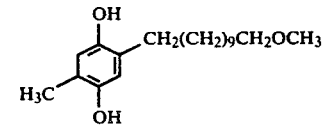
[I]-26
[I]-27
-continued
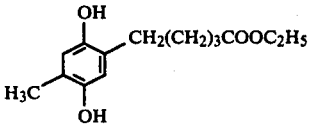
[I]-28
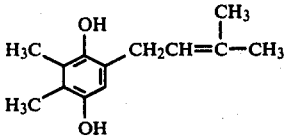
[I]-29
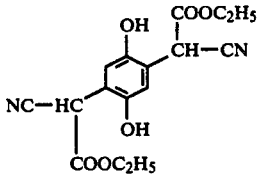
Examples of the compound represented by the general formula [II]:
[II]-1
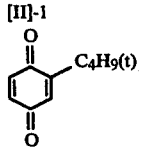
[II]-2
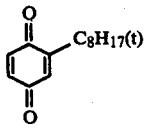
[II]-3
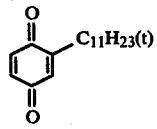
[II]-4
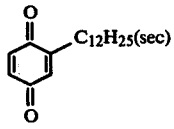
[II]-5
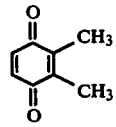
[II]-6
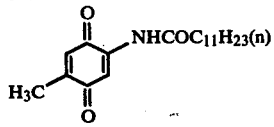
[II]-7
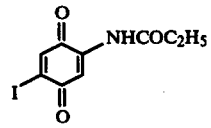
[II]-8
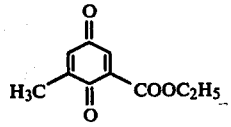
[II]-9
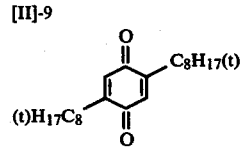
[II]-10
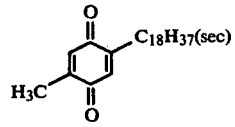
[II]-11
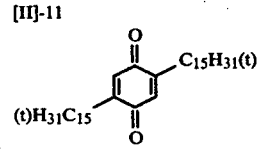
[II]-12
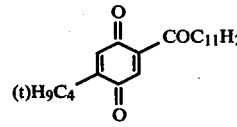
[II]-13
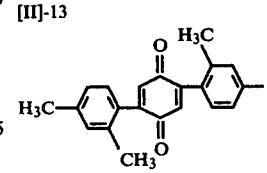
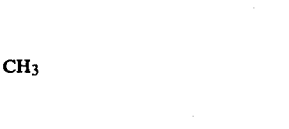
[II]-14
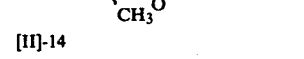

-continued

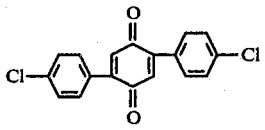

[II]-15

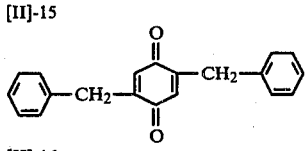

[II]-16

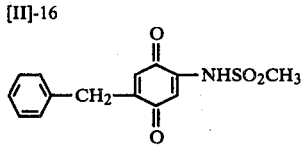

[II]-17

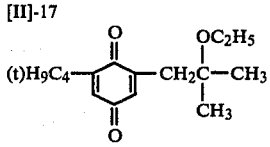

[II]-18

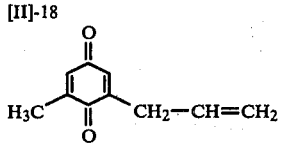

[II]-19

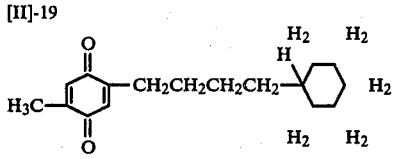

[II]-20

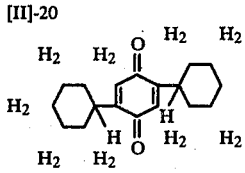

[II]-21

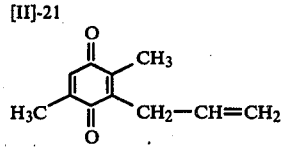

It was the unexpected that the aforesaid formation of fog can be inhibited by incorporating into at least one layer of a light-sensitive silver halide color photographic material at least one of the compounds represented by the general formula [I] and at least one of the compounds represented by the general formula [II]. It was not possible to anticipate at all such inhibition of the formation of fog, because hydroquinones of the general formula [I] usually contain therein 0.5 to 1.0% of p-benzoquinones of the general formula [II] as contaminants and when said hydroquinones are used in combination with said p-benzoquinones in a light-sensitive silver halide color photographic material, it follows that a further several percent of p-benzoquinones are supplemented to said color photographic material.

It has heretofore been well known to remove the formation of color stain from light-sensitive silver halide color photographic materials by the use of hydroquinones. For instance, U.S. Pat. Nos. 2,403,721 and 2,728,659 disclose the use of mono-n-alkylhydroquinones and di-n-alkylhydroquinones, and U.S. Pat. No. 2,675,314 proposes the use of hydroquinones having oxim groups, alkoxycarbonylalkylhydroquinones and carbamoylalkylhydroquinones. These compounds, however, are not sufficient to remove color stain caused by the use of 2-equivalent couplers and, in some cases, they promote the formation of fog on color photographic materials stored under the circumstances of high temperature and himidity. Further, the use of 2-alkyl-5-methylhydroquinones is disclosed, for example, in U.S. Pat. No. 2,732,300, that of di-t-alkylhydroquinones in U.S. Pat. No. 2,360,290, that of mixtures of secondary alkylhydroquinones in Japanese Laid-Open-to-Public Publication No. 2128/1971, and that of tertiary alkylhydroquinones in Japanese Laid-Open-to-Public Publication No. 29637/1979. According to experiments conducted by the present inventors, however, it has been ascertained that these compounds sometimes cause the formation of fog on color photographic materials when the photographic materials have been prepared under high speed coating and drying by means of hot air or are stored under the circumstances of high temperature and himidity, though they exhibit marked effect on inhibition of color fog due to an oxidation product of a developing agent resulting from air oxidation of the agent in a developer.

These alkylhydroquinones are known to have strong reducing power. Because of this strong reducing power, they effectively prevent the formation of color fog by deoxidizing an oxidation product of a developing agent, but, on that account, they tend to increase the formation of fog by reducing silver halide grains more than necessary.

Further, Japanese Laid-Open-to-Public Publications Nos. 106329/1975, 129535/1975 and 9828/1976 propose processes for removing color fog by using alkylhydroquinones. According to experiments conducted by the present inventors, however, it has been ascertained that in these processes, no effect on inhibition of fog formed at the time of high speed coating is seen and sometimes the formation of fog at that time is rather promoted, though color fog due to an oxidation product of a developing agent can be removed for the reason as aforesaid.

In accordance with the present invention, however, the aforesaid color fog can be effectively removed, as mentioned previously, by incorporating into light-sensitive silver halide color photographic materials the hydroquinones of the general formula [I] in combination with the p-benzoquinones of the general formula [II]. In this case, the mechanism of function of the p-benzoquinones has not be completely clarified yet, but it is perhaps considered that said p-benzoquinones would have certain effect on fog nuclei formed at the time of preparation of silver halide emulsions or precursors thereof, or on fog nuclei formed by pressure caused by sudden contraction of silver halide emulsions at the time of high speed coating thereof.

Japanese Patent Publication No. 4934/1968 discloses a technique of using alkyl-p-benzoquinones in silver halide photographic materials. In this case, however, sensitizing effect is expected by the use of a very small amount of the alkyl-p-benzoquinones and, therefore, it is in no way possible to anticipate therefrom that the p-benzoquinones used in the present invention are capable of removing color fog as mentioned previously.

The compounds represented by the general formulas [I] and [II] respectively can be easily synthesized. The hydroquinones of the general formula [I] can be readily prepared according to the procedures described in patents cited in the present specification with regard to the use of hydroquinones and in a book "METHODEN DER ORGANISCHEN CHEMIE (HOUBEN-WEYL), BAND VI/LC PHENOLE Teil 1" (GEORG THIEME VERLAG STUTTGART, 1976), or alternatively they can be readily synthesized by treating with appropriate reducing agents such p-benzoquinones as disclosed in a book "METHODEN DER ORGANISCHEN CHEMIE (HOUBEN-WEYL), BAND VII/3a" (GEORG THIEME VERLAG STUTTGART, 1977). Further, the p-benzoquinones of the general formula [II] can be readily synthesized according to the aforesaid METHODEN DER ORGANISCHEN CHEMIE and also by oxidation of hydroquinones obtained by the aforesaid patents according to the procedure disclosed on pages 10-29 of "RODDS CHEMISTRY OF CARBON COMPOUNDS III$^{B}$" (ELSEVIER SCIENTIFIC PUBLISHING COMPANY, 1974) or on pages 302-361 of "ORGANIC REACTIONS,", Vol. 4 (NEW YORK JOHNWILEY & SONS, Inc).

The hydroquinone derivatives of the general formula [I] used in the present invention include precursors thereof. The precursors as used herein are intended to mean compounds releasing on hydrolysis the hydroquinone derivatives. The precursors of this type include, for example, compounds as obtained by conversion, wherein one or two hydroxyl groups of hydroquinone derivatives have been acylated (e.g. $R-\underset{\underset{O}{\|}}{C}-O-$, $RO-\underset{\underset{O}{\|}}{C}-O$ or $RO-\underset{\underset{O}{\|}}{C}-\underset{\underset{O}{\|}}{C}-O-$)

in which R represents such aliphatic group as alkyl).

The present compounds may preferably contained in yellow, magenta and cyan dye image forming layers or layers adjacent thereto, though they may be contained in any layers constituting a color photographic material. In the present invention, the color photographic material may comprises only one dye image forming layer, but preferably the dye image forming layers are independently formed for forming yellow, magenta and cyan dye images respectively.

Generally, the present compounds are incorporated into layers constituting the color photographic material according to the procedure hereinafter illustrated. The present compounds which are generally oil-soluble are preferably dissolved in high boiling solvents, if necessary, in combination with low boiling solvents, according to the procedures disclosed in U.S. Pat. Nos. 2,322,027, 2,801,170, 2,801,171, 2,272,191 and 2,304,940 and the resultant is added by dispersion to a hydrophilic colloid solution. In that case, if necessary, there may be used couplers, ultraviolet absorbers or known dye image fading inhibitors in combination with the present compounds. In this case, the present compounds may be used in admixtures of two or more kinds of each of the present compounds. More particularly, the present compounds may be dissolved, if necessary, either separately or simultaneously, or together with couplers, ultraviolet absorbers or known dye image fading inhibitors, in high boiling solvents, if necessary in combination with low boiling solvents (these high and low boiling solvents may be used either singly or in admixture). The high boiling solvents usable in that case include organic acid amides, carbamates, esters, ketones, hydrocarbons and urea derivatives, particularly di-n-butyl phthalate, tricresyl phosphate, di-isooctyl azelate, di-n-butyl sebacate, tri-n-hexyl phosphate, decalin, N,N-diethylcaprylamide, N,N-diethyl laurylamide, n-pentadecylphenyl ether, of fluoroparaffin, and the low boiling solvents include ethyl acetate, butyl acetate, butyl propionate, cyclohexanol, cyclohexane tetrahydrofuran, etc. The resulting solution is then mixed with an aqueous solution of a hydrophilic binder, such as gelatin, containing anionic surface active agents such as alkylbenzenesulfonic acids and alkylnaphthalenesulfonic acids and/or nonionic surface active agents such as sorbitansesquioleic acid esters and sorbitanmonooleic acid esters, and the resulting mixture is emulsified and dispersed by means of a high speed rotary mixer, colloid mill, ultrasonic dispersing apparatus or the like. The thus obtained dispersion is used after incorporating it into a hydrophilic colloid solution (e.g. silver halide emulsions).

The hydrophilic colloid solution obtained in the manner above explained (when this solution is intended to be a silver halide emulsion, the silver halide mentioned later is incorporated into said solution) is coated on a support to obtain a light-sensitive silver halide color photographic material. The thus obtained light-sensitive silver halide color photographic material is subjected to such photographic treatment as mentioned later to obtain a color photographic material having formed thereon a desired color image.

Further, the present compounds can also be readily dispersed according to dispersing procedures relying on the use of latex solutions as disclosed in U.S. Pat. Nos. 2,269,158, 2,852,382, 2,772,168, 3,619,195 and 2,801,170, Japanese Laid-Open-to-Public Publications Nos. 59942/1976, 59943/1976, 74538/1974, 17637/1975, 25132/1976 and 110327/1976.

Of the present compounds, moreover, those which are alkali soluble (or water soluble) can be incorporated in the form of alkaline solution (or in the form of aqueous solution) into the hydrophilic colloid solution.

The present invention which has been dispersed in the manner above explained is preferably incorporated into a silver halide emulsion layer or a layer adjacent thereto, particularly in a yellow dye image forming layer or a layer adjacent thereto. The present compounds are particularly effective when used in an emulsion layer containing 2-equivalent yellow dye image forming couplers out of the yellow dye image forming couplers.

Although the amount of the present compound of the general formula [I] to be incorporated is not particularly limited, it is generally preferable to use said compound, mainly for economical reasons, in an amount of about 0.01 to about 90% by weight, particularly preferably 0.1 to 85% by weight, based on a dry weight of the hydrophilic colloid used. The amount of the present compound of the general formula [II] to be incorporated is preferably at least 2%, more preferably 2 to 300%, particularly preferably 4 to 200% in terms of mole percentage, based on the compound of the general formula [I].

In the light-sensitive silver halide color photographic materials according to the present invention, there may be used any dye image forming couplers.

Of the usable dye image forming couplers, preferably usable yellow dye image forming couplers are those of benzoylacetanilide or pivaloylacetanilide type, or 2-equivalent type yellow dye image forming couplers, in which the carbon atom at the coupling position has been substituted by a substituent (the so-called split-off group) capable of being liberated therefrom at the time of coupling reaction. Similarly, magenta dye image forming couplers are those of 5-pyrazolone, pyrazolotriazole, pyrazolinobenzimidazole or indazolone type, or 2-equivalent type magenta dye image forming couplers having split-off groups, and cyan dye image forming couplers are those of phenol, naphthol or pyrazoloquinazolone type, or 2-equivalent type cyan dye image forming couplers.

Yellow couplers applicable to the present invention are explained more in detail. They are represented by the following formula:

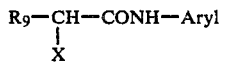

wherein $R_9$ represents an α-pivalyl or α-benzoyl group; X represents a hydantoin, urazol, oxazolidindion, benzotriazol, tetrazolon or aryloxy group or its derivatives; Aryl represents an aryl group.

Typical examples of the dye image forming coupler used in the present invention are exemplified below.

(Y-1)
α-(4-Carboxyphenoxy)-α-pivalyl-2-chloro-5-[γ-(2,4-di-t-amylphenoxy)butylamido]acetanilide (Y-2)
α-Benzoyl-2-chloro-5-[γ-(2,4-di-t-amylphenoxy)-butylamido]acetanilide (Y-3)
α-Benzoyl-2-chloro-5-[α-(dodecyloxycarbonyl)ethoxycarbonyl]acetanilide (Y-4)
α-(4-Carboxyphenoxy)-α-pivalyl-2-chloro-5-[α-(3-pentadecylphenoxy)butylamido]acetanilide (Y-5)
α-(1-Benzyl-2,4-dioxo-3-imidazolidinyl)-α-pivalyl-2-chloro-5-[γ-(2,4-di-t-amylphenoxy)-butylamido]acetanilide (Y-6)
α-[4-(1-Benzyl-2-phenyl-3,5-dioxo-1,2,4-triazolidinyl)]-α-pivalyl-2-chloro-5-[γ-(2,4-di-t-amylphenoxy)butylamido]acetanilide (Y-7)
α-Acetoxy-α-{3-[α-(2,4-di-t-amylphenoxy)-butylamido]benzoyl}-2-methoxyacetanilide (Y-8)
α-{3-[α-(2,4-di-t-Amylphenoxy)butylamido]benzoyl}-2-methoxyacetanilide (Y-9)
α-[4-(4-Benzyloxyphenylsulfonyl)phenoxy]-α-pivalyl-2-chloro-5-[γ-(2,4-di-t-amylphenoxy)-butylamido]acetanilide (Y-10)
α-Pivalyl-α-(4,5-dichloro-3(2H)-pyridazo-2-il)-2-chloro-5-[(hexadecyloxycarbonyl)methoxycarbonyl]acetanilide (Y-11)
α-Pivalyl-α-[4-(p-chlorophenyl)-5-oxo-$\Delta^2$-tetrazoline-1-il]-2-chloro-5-[α-(dodecyloxycarbonyl)ethoxycarbonyl]acetanilide (Y-12)
α-(2,4-Dioxo-5,5-dimethyloxazolidine-3-il)-α-pivalyl-2-chloro-5-[α-(2,4-di-t-amylphenoxy)-butylamido]acetanilide (Y-13)
α-Pivalyl-α-[4-(1-methyl-2-phenyl-3,5-dioxo-1,2,4-triazolidinyl)]-2-chloro-5-[γ-(2,4-di-t-amylphenoxy) butylamido]acetanilide (Y-14)
α-Pivalyl-α-[4-(p-ethylphenyl)-5-oxo-$\Delta^2$-tetrazolyl-1-il]-2-chloro-5-[γ-(2,4-di-t-amylphenoxy)-butylamido]acetanilide (M-1)
1-(2,4,6-Trichlorophenyl)-3-[3-(2,4-di-t-amylphenoxyacetamido)benzamido]-5-pyrazolone (M-2)
1-(2,4,6-Trichlorophenyl)-3-(3-dodecylsuccinimidobenzamido)-5-pyrazolone (M-3)
4.4'-Methylenebis{1-(2,4,6-trichlorophenyl)-3-[3-(2,4-di-t-amylphenoxyacetamido)benzamido]}-5-pyrazolone (M-4)
1-(2,4,6-Trichlorophenyl)-3(2-chloro-5-octadecylsuccinimidoanilino)-5-pyrazolone (M-5)
1-(2-Chloro-4,6-dimethylphenyl)-3-{3-[α-(3-pentadecylphenoxy)butylamido]benzamido}-5-pyrazolone (M-6)
1-(2,4,6-Trichlorophenyl)-3-(2-chloro-5-octadecylcarbamoylanilino)-5-pyrazolone (M-7)
3-Ethoxy-1-{4-[α-(3-pentadecylphenoxy)-butylamido]phenyl}-5-pyrazolone (M-8)
1-(2,4,6-Trichlorophenyl)-3-(2-chloro-5-tetradecanamidoanilino)-5-pyrazolone (M-9)
1-(2,4,6-Trichlorophenyl)-3-{2-chloro-5-[α-(t-butyl-4-hydroxyphenoxy)tetradecanamido]anilino}-5-pyrazolone (M-10)
1-(2,4,6-Trichlorophenyl)-3-[3-(2,4-di-t-amylphenoxyacetamido)benzamido]-4-acetoxy-5-pyrazolone (M-11)
1-(2,4,6-Trichlorophenyl)-3-[3-(2,4-di-t-amylphenoxyacetamido)benzamido]-4-ethoxycarbonyloxy-5-pyrazolone (M-12)
1-(2,4,6-Trichlorophenyl)-3-[3-(2,4-di-t-amylphenoxyacetamido)benzamido]-4-(4-chlorocinnamoyloxy)-5-pyrazolone (M-13)
4.4'-Benzylidenebis[[1-(2,4,6-trichlorophenyl)-3-{2-chloro-5-[γ-(2,4-di-t-amylphenoxy)-butylamido]anilino}-5-pyrazolone]]

(M-14)
4,4'-Benzylidenebis[[1-(2,3,4,5,6-pentachlorophenyl)-3-{2-chloro-[γ-(2,4-di-t-amylphenoxy)-butylamido]anilino}-5-pyrazolone]]

(M-15)
4,4'-(2-chloro)benzylidenebis[1-(2,4,6-trichlorophenyl)-3-(2-chloro-5-dodecylsuccinimidoanilino-5-pyrazolone]

(M-16)
4,4'-Methylenebis[[1-(2,4,6-trichlorophenyl)-3-{3-[α-(2,4-di-t-amylphenoxy)butylamido]benzamido}-5-pyrazolone]]

(M-17)
1-(2,6-Dichloro-4-methoxyphenyl)-3-(2-methyl-5-acetamidoanilino)-5-pyrazolone (M-18)
1-(2-Chloro-4,6-dimethylphenyl)-3-(2-methyl-5-chloroanilino)-5-pyrazolone (M-19)
1-(2,4,6-Trichlorophenyl)-3-(4-nitroanilino)5-pyrazolone (M-20)
1-(2,4,6-Trichlorophenyl)-3-(2-chloro-5-octadecenylsuccinimido-anilino)-5-pyrazolone (M-21)
1-(2,4,6-Trichlorophenyl)-3-(2-chlorotridecanamidoanilino)-5-pyrazolone
(C-1)
1-Hydroxy-N-[δ-(2,4-di-t-amylphenoxy)butyl]-2-naphthamide
(C-2)
2,4-Dichloro-3-methyl-6-(2,4di-t-amylphenoxyacetamido)phenol
(C-3)
2,4-Dichloro-3-methyl-6-[α-(2,4-di-t-amylphenoxy)butylamido]phenol
(C-4)
1-Hydroxy-4-(3-nitrophenylsulfonamido)-N-[δ-(2,4-di-t-amylphenoxy)butyl]-2-naphthamide
(C-5)
1-Hydroxy-4-[(δ-methoxyethyl)carbamoyl]methoxy-N-[δ-(2,4-di-t-amylphenoxy)butyl]-2-naphthamide
(C-6)
1-Hydroxy-4-(isopropylcarbamoyl)methoxy-N-dodecyl-2-naphthamide
(C-7)
2-Perfluorobutylamido-5-[α-(2,4-di-t-amylphenoxy)hexanamido]phenol
(C-8)
1-Hydroxy-4-(Δ-nitrophenylcarbamoyl)oxy-N-[δ-(2,4-di-t-amylphenoxy)butyl]-2-naphthamide
(C-9)
2-(α,α,β,β-Tetrafluoropropionamido-5-[α-(2,4-di-t-amylphenoxy)butylamido]phenol
(C-10)
1-Hydroxy-N-dodecyl-2-naphthamide
(C-11)
1-Hydroxy-(4-nitro)phenoxy-N-[δ-(2,4-di-t-amylphenoxy)butyl]-2-naphthamide
(C-12)
1-Hydroxy-4-(1-phenyl-5-tetrazolyloxy)-N-[δ-(2,4-di-t-amylphenoxy)butyl]-2-naphthamide
(C-13)
2-(α,α,β,β-Tetrafluoropropionamide)-4-β-chloroethoxy-5-[α-(2,4-di-t-amylphenoxy)butylamido]phenol The amount of the couplers used in the light-sensitive silver halide color photographic material according to the present invention, when they are made present in said photographic material, is generally 5 to 50 mol%, preferably 10 to 30 mol%, based on silver halide and, when they are made present in a developer, is generally 0.5 to 3.0 g/l, preferably 1.0 to 2.0 g/l.

Silver halide emulsions used in the light-sensitive silver halide color photographic materials are generally prepared by dispersing silver halide particles in a hydrophilic colloid. The silver halide used in this case includes silver chloride, silver bromide, silver iodide, silver chlorobromide, silver iodobromide, silver chloroiodobromide and mixtures thereof. These silver halides may be prepared by a variety of processes such as ammonia process, neutral process, the so-called conversion process and simultaneous mixing process. Hydrophilic colloid into which the silver halide is dispersed includes generally gelatin and gelatin derivatives such as phthalated gelatin and malonated gelatin. There may also be used, in place of a part or whole of the gelatin or gelatin derivatives, albumin, agar agar, gum arabic, alginic acid, casein, partially hydrolized cellulose derivatives, partially hydrolized polyvinyl acetate, polyacrylamides, imidated polyacrylamides, polyvinylpyrrolidone and copolymers of these vinyl compounds. Further, these silver halide emulsions may be optically sensitized with a variety of sensitizing dyes in order to impart photosensitivity at a desired photosensitive wavelength region to said emulsions. Preferable sensitizing dyes are, for example, cyanine dyes, merocyanine dyes or composite cyanine dyes, which are usable either singly or in combination of two or more. The silver halide emulsions thus treated may further be incorporated, if necessary, with a variety of photographic additives, for example, chemical sensitizers such as thioether compounds, quaternary ammonium salt compounds or polyalkylene oxide compounds; stabilizers such as triazoles, imidazoles, azaindenes, benzothiazolums, zinc compounds, cadmium compounds and mercaptans; film hardeners such as chromium salts, zirconium salts, mucochloric acid, and hardeners of aldehyde, halotriazine, polyepoxy or acryloyl type; plasticizers such as glycerine, dihydroxyalkanes such as 1,5-pentanediol; fluorescent brightening agent; antistatic agents; and coating aids, and these additives may be used either singly or in combination of two or more. The silver halide emulsion is then incorporated with the aforesaid dispersion containing the present compounds, and the resulting emulsion is coated, if necessary through a sub layer, intermediate layer or protective layer, on a support such as synthetic resin films of cellulose acetate, cellulose nitrate, polycarbonate, polyethylene terephthalate or polystyrene, baryta papers, polyethylene-coated papers or glass plates, whereby a light-sensitive silver halide color photographic material is obtained.

The light-sensitive silver halide color photographic material according to the present invention is applicable to coupler-containing inner type silver halide color photographic materials, or outer type silver halide color photographic materials, wherein couplers used are contained in a developer. The present color photographic material is advantageously applicable, in particular, to coupler-containing inner type silver halide color photographic materials and, in this case, after exposure, color development of said photographic materials is effected according to the color developing process to obtain color photographic materials having formed thereon desired color images.

An advantageous treatment of the present color photographic materials includes, for example, processing steps for color development, if necessary, followed by water-washing, bleach-fixing, water-washing, if necessary followed by stabilization, and water-washing. The processing steps are individually carried out at an elevated temperature of 30° C. or above and in a very short time.

Given below are typical of the processing steps and of composition of each processing solution used therein.

| | Processing time |
|---|---|
| Processing step (30° C.) | |
| Color development | 3' 30" |
| Bleach-fixing | 1' 30" |
| Water-washing | 2' |
| Stabilization | 1' |
| Drying | |
| Composition of color developer: | |
| Benzyl alcohol | 5.0 ml |
| Sodium hexametaphosphate | 2.5 g |
| Anhydrous sodium sulfite | 1.9 g |
| Sodium bromide | 1.4 g |
| Potassium bromide | 0.5 g |
| Boric acid ($Na_2B_4O_7 \cdot 10H_2O$) | 39.1 g |

-continued

| | Processing time |
|---|---|
| N-Ethyl-N-β-methanesulfonamido-ethyl-4-aminoaniline sulfate | 5.0 g |
| Water to make 1 liter and adjust pH to 10.30 with sodium hydroxide. | |
| Composition of bleach-fixing composition: | |
| Iron ammonium ethylenediamine-tetraacetate | 61.0 g |
| Diammonium ethylenediamine-tetraacetate | 5.0 g |
| Ammonium thiosulfate | 124.5 g |
| Ammonium metabisulfite | 13.3 g |
| Water to make 1 liter and adjust pH to 6.5 with ammonia water | |
| Composition of stabilizing solution: | |
| Glacial acetic acid | 20 ml |
| 800 ml of water is added and, after adjusting pH to 3.5–4.0 with sodium acetate, water is further added to make 1 liter. | |

Particularly useful color developing agents for color developing the light-sensitive silver halide color photographic materials are primary phenylenediamines, aminophenols and their derivatives, typical of which may be, for example, those mentioned below.

Salts of inorganic acids such as hydrochloric acid and sulfuric acid or organic acids such as p-toluenesulfonic acid of N,N-dimethyl-p-phenylenediamine, N,N-diethyl-p-phenylenediamine, N-carbamidoethyl-N-methyl-p-phenylenediamine, N-carbamidomethyl-N-tetrahydrofuryl-2-methyl-p-phenylenediamine, N-ethyl-N-carboxymethyl-2-methyl-p-phenylenediamine, N-carbamidomethyl-N-ethyl-2-methyl-p-phenylenediamine, N-ethyl-N-tetrahydrofuryl-2-methyl-p-aminophenol, 3-acetylamino-4-aminodimethylaniline, N-ethyl-N-β-methanesulfonamidoethyl-4-aminoaniline, N-ethyl-N-β-methanesulfonamidoethyl-3-methyl-4-aminoaniline, 3-methyl-4-amino-N-ethyl-N-β-methoxyethylaniline, N-ethyl-N-β-β-(β-methoxyethoxy)ethoxy ethyl-3-methyl-4-aminoaniline, N-ethyl-N-β-(β-methoxyethoxy)ethyl-3-methyl-4-aminoaniline, N,N-diethyl-3-methyl-p-phenylenediamine and N-methyl-N-β-sulfoethyl-p-phenylenediamine.

The present invention is illustrated below in detail with reference to examples.

EXAMPLE 1

A solution of 61 g of yellow coupler (Y-5) in 61 ml of dibutyl phthalate and 120 ml of ethyl acetate was divided into 8 portions. One portion of which was used as a control, and the remaining 7 portions were individually incorporated with 2,5-di-t-octylhydroquinone and 2,5-di-t-octyl-p-benzoquinone in varying proportions as shown in Table 1. The eight solutions were individually incorporated with equal poriton of 500 ml of a 5% aqueous gelatin solution containing 3.0 g of sodium dodecylbenzenesulfonate, and then dispersed by means of a homogenizer to obtain dispersions. The dispersions thus obtained were individually incorporated into 125 ml (Ag X 0.051 mole contained) of a blue-sensitive silver chlorobromide (containing 10 mol% of silver chloride) emulsion, followed by addition with stirring thereto of a 5% methanol solution (33 ml/l mole Ag X) of triethylenephosponamide and a 1% aqueous solution (700 ml/l mole Ag X) in that order, and the emulsions were individually coated on a subbed cellulose triacetate base and then dried to prepare samples Nos. 1–8. Each sample, after having been cut in suitable size for measurement, was subjected to wedgewise exposed to blue light, followed by treatment according to the processing steps as mentioned previously, and in this treatment, the processing steps were carried out at the development time of 30° C. and 32.8° C., respectively. The yellow images thus obtained were subjected to sensitometry with a densitometer of PDA-60 model manufactured by Konishiroku Photo Industry Co., Ltd. to obtain the results as shown in Table 1, wherein the speed was represented by a relative value as measured by assuming as 100 of the speed of the control (sample No. 1).

Sensitizing dye used:

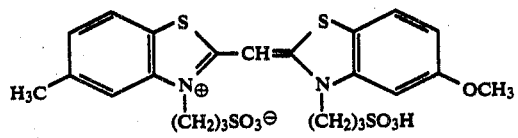

TABLE 1

| Sample No. | Added amount of 2,5-di-t-octylhydroquinone | Added amount of 2,5-di-t-octyl-p-benzoquinone | Developing temperature 30° C. | | Developing temperature 32.8° C. | |
|---|---|---|---|---|---|---|
| | | | Fog | Speed | Fog | Speed |
| (1) | — | — | 0.13 | 100 | 0.15 | 100 |
| (2) | 200 mg | 0 | 0.10 | 95 | 0.12 | 96 |
| (3) | 200 mg | 2 mg | 0.09 | 95 | 0.12 | 95 |
| (4) | 200 mg | 4 mg | 0.06 | 93 | 0.08 | 94 |
| (5) | 200 mg | 20 mg | 0.05 | 92 | 0.06 | 93 |
| (6) | 200 mg | 50 mg | 0.04 | 91 | 0.05 | 92 |
| (7) | 200 mg | 100 mg | 0.03 | 90 | 0.04 | 92 |
| (8) | 200 mg | 200 mg | 0.03 | 90 | 0.04 | 91 |

As is clear from Table 1, it is understood that no decrease in the photographic speed is observed and fog is remarkably removed when 2,5-di-t-octyl-p-benzoquinone is used in the range of 2 to 20% in terms of mole percentage, based on 2,5-di-t-octylhydroquinone.

EXAMPLE 2

Samples of emulsions were prepared in the same manner as in Example 1, and the present compounds and known color fog inhibitors were incorporated in each sample in the manner as shown in Table 2 in place of the 2,5-di-t-octylhydroquinone and 2,5-di-t-octyl-p-benzoquinone used in Example 1, and the samples Nos. 9–17 were prepared in the same manner as in Example 1. The samples were treated in the same procedure as in Example 1 and then measured in fog as well as in speed. The results obtained were as shown in Table 2 in which, however, the fog and speed were measured by using the samples on the same day as prepared and after storing for 2 days under the circumstances of high temperature and himidity (50° C. and 80% RH). The development temperature employed was 32.8° C., and sample No. (9) was used as a control.

TABLE 2

| Sample No. | Hydroquinones and amount used (mg) | | p-Hydroquinones and amount used (mg) | | On the same day as prepared Fog | Speed | After storing for 2 days Fog | Speed |
|---|---|---|---|---|---|---|---|---|
| (9) | — | — | — | — | 0.13 | 100 | 0.18 | 100 |
| (10) | [I]-6 | 220 | — | — | 0.09 | 97 | 0.20 | 96 |
| (11) | [I]-6 | 220 | [II]-9 | 15 | 0.04 | 93 | 0.07 | 94 |
| (12) | [I]-4 + [I]-14 | 250 | — | — | 0.08 | 97 | 0.18 | 97 |
| (13) | [I]-4 + [I]-14 | 10 + 150 | [II]-4 + [II]-9 | 5 + 15 | 0.04 | 94 | 0.06 | 93 |
| (14) | [I]-15 | 250 | — | — | 0.09 | 98 | 0.21 | 98 |
| (15) | [I]-15 | 250 | [II]-11 | 14 | 0.05 | 93 | 0.07 | 92 |
| (16) | [I]-10 | 180 | — | — | 0.09 | 96 | 0.22 | 96 |
| (17) | [I]-10 | 180 | [II]-9 | 15 | 0.04 | 92 | 0.06 | 92 |

As is clear from Table 2, it is understood that in sample No. 10 (using compound of U.S. Pat. No. 2,675,314), sample No. 12 (using compound of Japanese Laid-Open-to-Public Publn. 2128/1971), sample No. 6 (using compound of Japanese laid-Open-to-Public Publn. 29637/1979) and sample No. 16 (using compound of U.S. Pat. No. 2,403,721), there are observed increases in formation of fog when they are stored under the circumstances of high temperature and humidity. On the other hand, it is understood that by virtue of adding p-benzoquinones to the above-mentioned samples, fog can be effectively remove without causing any decrease in speed.

EXAMPLE 3

A solution of 36 g of magenta coupler (M-1), 9.6 g of 2,5-dioctylhydroquinonedioctyl ether (color image fading inhibitor) and compounds as shown in Table 3 in 62 ml of dibutyl phthalate and 100 ml of ethyl acetate was dispersed in a 5% aqueous gelatin solution containing 2.5 g of sodium dodecylbenzenesulfonate by means of a homogenizer. The dispersion was incorporated into 1000 ml (containing Ag x 0.35 mole) of a green-sensitive silver chlorobromide (containing 40 mol% of silver chloride) emulsion, followed by addition thereto of 10 ml of a 2% methanol solution of N,N',N'''-triacryloyl-6H-S-triazine. The emulsions thus prepared were individually coated on a polyethylene-coated paper and quick dried by jetting hot air kept at 60° C. to prepare samples Nos. 18–24. The samples were treated in the same manner as mentioned previously and then measured in color fog to obtain the results as shown in Table 3.

Sensitizing dye used:

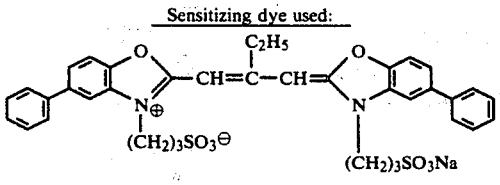

TABLE 3

| Sample No. | Hydroquinones and amount used (mg) | | p-Benzoquinones and amount used (mg) | | Fog | Speed |
|---|---|---|---|---|---|---|
| (18) | — | — | — | — | 0.12 | 100 |
| (19) | I-12 | 1200 | — | — | 0.08 | 98 |
| (20) | I-12 | 1200 | II-9 | 40 | 0.04 | 93 |
| (21) | I-14 | 1200 | — | — | 0.10 | 96 |
| (22) | I-14 | 1200 | II-10 | 45 | 0.05 | 92 |
| (23) | I-15 | 1200 | — | — | 0.08 | 94 |

TABLE 3-continued

| Sample No. | Hydroquinones and amount used (mg) | | p-Benzoquinones and amount used (mg) | | Fog | Speed |
|---|---|---|---|---|---|---|
| (24) | I-15 | 1200 | II-11 | 60 | 0.03 | 91 |

As is clear from Table 3, it is understood that there are observed increses in fog in sample No. 21 (compound of Japanese Laid-Open-to-Public Publn. 2128/1971) and sample No. 23 (compound of Japanese Laid-Open-to-Public Publn. 29637) wherein relatively small increases in fog were observed in Example 2, when subjected to coating with hot air kept at elevated temperature. However, it is understood that by virtue of addition to these sample of p-benzoquinones, fog can be removed without causing decrease in speed.

EXAMPLE 4

A solution of 46 g of cyan coupler (C-1), 10 g of 2,5-di-t-amylhydroquinonedioctyl ether (color image fading inhibitor) and compounds as shown in Table 4 in 50 ml of dibutyl phthalate and 120 ml of ethyl acetate was incorporated into a 5% aqueous gelatin solution containing 2.5 g of sodium dodecylbenzenesulfonate, and the resulting mixture was dispersed by means of a homogenizer to prepare a dispersion. The dispersion thus prepared was incorporated into 1000 ml (containing Ag x 0.35 mole) of a red-sensitive silver chlorobromide (containing 20 mol% of silver chloride) emulsion, followed by addition thereto of 20 ml of a 4% aqueous solution of sodium 2,4-dichloro-6-hydroxy-s-triazine, and the emulsion was coated on a polyethylene-coated paper and then dried to obtain samples Nos. 25–33. The samples were stored for 2 days under the circumstances of high temperature and humidity (55° C. and 80% RH) to observe increases in fog, after treatment as mentioned previously.

Sensitized dye used:

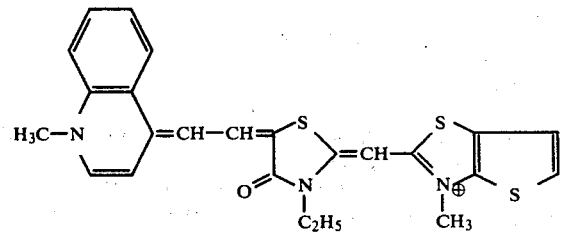

-continued

Sensitized dye used:

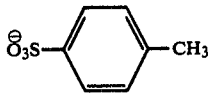

TABLE 4

| Sample No. | Hydroquinones and amount used (mg) | | p-Benzoquinones and amount used (mg) | | On the same day as prepared Fog | Speed | After storing for 2 days Fog | Speed |
|---|---|---|---|---|---|---|---|---|
| (25) | | | | | 0.12 | 100 | 0.18 | 100 |
| (26) | [I]-6 | 500 | | | 0.08 | 93 | 0.18 | 90 |
| (27) | [I]-6 | 500 | [II]-6 | 25 | 0.02 | 93 | 0.04 | 93 |
| (28) | [I]-16 | 500 | | | 0.08 | 90 | 0.17 | 92 |
| (29) | [I]-16 | 500 | [II]-9 + [II]-10 | 12.5 + 12.5 | 0.03 | 89 | 0.05 | 91 |
| (30) | [I]-12 | 500 | | | 0.10 | 91 | 0.19 | 93 |
| (31) | [I]-12 | 500 | [II]-9 | 25 | 0.03 | 90 | 0.05 | 91 |
| (32) | Gentisal | doxim 500 | | | 0.09 | 89 | 0.16 | 93 |
| (33) | Gentisal | doxim 500 | [II]-10 | 25 | 0.02 | 88 | 0.04 | 90 |

As is clear from Table 4, it is understood that sample No. 26 (containing compound of U.S. Pat. No. 2,675,314), sample No. 28 (containing U.S. Pat. No. 2,732,300), sample No. 30 (containing compound of U.S. Pat. No. 2,360,290) and sample No. 32 (containing compound of U.S. Pat. No. 2,675,314) are all liable to form fog under the circumstances of high temperature and humidity, and that fog can be effectively removed without causing decrease in speed, however, by virtue of adding thereto of p-benzoquinones.

EXAMPLE 5

On a polyethylene-coated paper support were coated successively from the support side the under-mentioned layers to prepare a sample of light-sensitive silver halide color photographic material. (Sample A) 1st layer:

A blue-sensitive silver halide emulsion layer comprising silver chlorobromide emulsion containing 10 mol% of silver chloride, said emulsion containing 400 g of gelatin per mole of silver halide, being sensitized with $2.5\times10^{-4}$ of the sensitizing dye of the following structure per mole of silver halide, containing a yellow coupler α-[4-(1-benzyl-2-phenyl-3,5-dioxo-1,2,4-triazodinyl)]-α-pivalyl-2-chloro-5-[γ-(2,4-di-t-amylphenoxy)butylamido]acetanilide dissolved and dispersed in DBP, and being coated at a silver coverage of 400 mg/m².

Sensitizing dye:

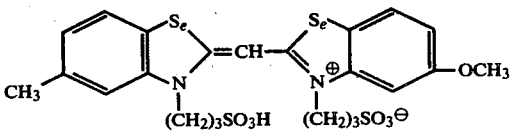

2nd layer:

A gelatin layer being coated so as to have a dry film thickness of 1μ.

3rd layer:

A green-sensitive silver halide emulsion layer comprising a silver chlorobromide emulsion containing 40 mol% of silver chloride, said emulsion containing 500 g of gelatin per mole of silver halide, being sensitized with $2.5\times10^{-4}$ of the sensitizing dye of the following structure per mole of silver halide, containing a magenta coupler dissolved and dispersed in TCP, 4,4'-benzylidenebis[(1-(2,3,4,5,6-pentachlorophenyl)-3-{2-chloro-5-[γ-(2,4-di-t-amylphenoxy)-butylamido]anilino}-5-pyrazolone)] per mole of silver halide, and being coated at a silver coverage of 350 mg/m².

Sensitizing dye used:

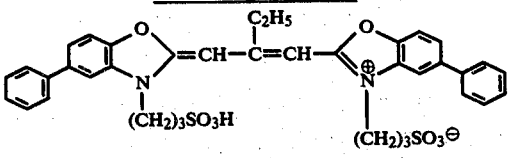

4th layer:

A gelatin layer of 1μ in thickness containing 700 mg/m² of 2-(2'-hydroxy-3',5'-di-t-butylphenyl)benztriazole as ultraviolet absorber dissolved and dispersed in DBP.

5th layer:

A red-sensitive silver halide emulsion layer comprising a silver chlorobromide emulsion containing 20 mol% of silver chloride, said emulsion containing 500 g of gelatin per mole of silver halide, being sensitized with $2.5\times10^{-4}$ mole of the sensitizing dye of the following structure per mole of silver halide, containing $2\times10^{-1}$ mole of a cyan coupler dissolved and dispersed in TCP per mole of silver halide, 2,4-dichloro-3-methyl-6-[α-(2,4-di-t-amylphenoxy)butylamido]phenol, and being coated at a silver coverage of 500 mg/m².

Sensitizing dye used:

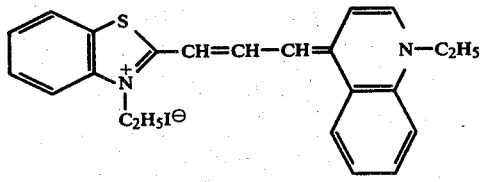

6th layer:

A gelatin layer being coated so as to have a dry film thickness of 1μ (protective layer).

The silver halide emulsions used in the photosensitive layers (1st, 3rd and 5th layers) were prepared according to the procedure as disclosed in Japanese Patent Publication No. 7772/1971, chemically sensitized with sodium thiosulfate pentahydrate, and incorporated with 4-hydroxy-6-methyl-1,3,3a,7-tetrazaindene as stabilizer, bis(vinylsulfonylmethyl) ether as film hardener and saponin as coating aid.

Subsequently, sample (B) was prepared by incorporating 2,5-di-t-octylhydroquinone into the 1st, 2nd, 3rd, 4th and 5th layers, respectively, in the proportion of 30, 25, 20, 25 and 10 mg/m$^2$.

Further, sample (C) was prepared by incorporating 2,5-di-t-octyl-p-benzoquinone in the proportion of 4 mol% based on the 2,5-di-t-octylhydroquinone content into each of the abovementioned layer of the sample (B).

The samples thus prepared were individually wedgewise exposed to blue, green and red light and then processed in the manner as mentioned previously to obtain the results of measurements of fog and speed for the purpose of comparison, as shown in Table 5. Further, these samples were stored for 2 days under the circumstances of high temperature and himidity (55° C. and 80% RH) and then processed likewise to observe change in photographic properties thereof, as shown in Table 5.

TABLE 5

| Sample No. | On the same day as prepared | | | | | | After storing for 2 days | | | | | |
|---|---|---|---|---|---|---|---|---|---|---|---|---|
| | Fog | | | Speed | | | Fog | | | | Speed | |
| | DB | DG | DR | B | G | R | DB | DG | DR | B | G | R |
| (A) | 0.11 | 0.08 | 0.08 | 100 | 100 | 100 | 0.16 | 0.12 | 0.10 | 100 | 100 | 100 |
| (B) | 0.08 | 0.06 | 0.06 | 98 | 95 | 96 | 0.10 | 0.08 | 0.10 | 98 | 97 | 98 |
| (C) | 0.05 | 0.04 | 0.03 | 96 | 94 | 95 | 0.07 | 0.05 | 0.05 | 96 | 96 | 96 |

As is clear from Table 5, the process of the present invention as illustrated by the use of sample (C) is very effective on inhibition of fog in the color photographic material.

What we claim is:

1. A photographic material having a silver halide emulsion layer coated on a support, which contains a compound represented by the following general formula [I] and one represented by the following general formula [II]:

General formula [I]

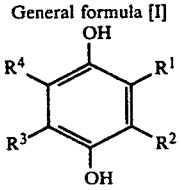

General formula [II]

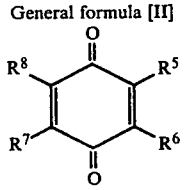

wherein $R^1$, $R^2$, $R^3$, $R^4$, $R^5$, $R^6$, $R^7$ and $R^8$ each represent a hydrogen or halogen atom, an alkyl, cycloalkyl, alkenyl, aryl, acyl, acylamino, sulfone or sulfonamido group, which may be the same of different, and each of said groups may have a substituent which does not form a colored dye on reaction with an oxidation product of a developing agent.

2. A photographic material according to claim 1 wherein the silver halide emulsion layer contains a yellow dye image forming coupler.

3. A photographic material according to claim 2 wherein the yellow dye image forming coupler is a 2-equivalent coupler.

4. A photographic material according to claim 1 wherein the content of the compound represented by the general formula [II], based on that of the compound represented by the general formula [I], is in the range of from 2 to 200 in mole percent.

5. A light-sensitive silver halide color photographic material according to claim 1, wherein at least one of $R^1$, $R^2$, $R^3$, $R^4$, $R^5$, $R^6$, $R^7$ and $R^8$ in the general formulas [I] and [II] is a secondary or tertiary alkyl group.

6. A light-sensitive silver halide color photographic material according to claim 1, wherein the compounds represented by the general formulas [I] and [II] are 2,5-di-t-octylhydroquinone and 2,5-di-t-octyl-p-benzoquinone, respectively.

7. A photographic material having a silver halide emulsion layer coated on a support, which contains a compound represented by the following general formula [I] and a compound represented by the following general formula [II]:

General formula [I]

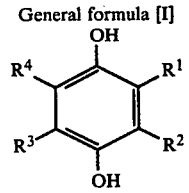

General formula [II]

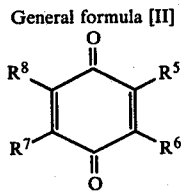

wherein $R^1$, $R^2$, $R^3$, $R^4$, $R^5$, $R^6$, $R^7$ and $R^8$ each represent a hydrogen or halogen atom, al alkyl, cycloalkyl, alkenyl, aryl, acyl, acylamino or sulfonamido group, which may be the same of different, and each of said groups may have a substituent which does not form a colored dye on reaction with an oxidation product of a developing agent.

* * * * *